US008879974B2

(12) United States Patent
Ando et al.

(10) Patent No.: US 8,879,974 B2
(45) Date of Patent: Nov. 4, 2014

(54) IMAGE HEATING DEVICE WITH A BELT LATERAL SHIFTING DIRECTION REGULATING MECHANISM

(71) Applicant: Canon Kabushiki Kaisha, Tokyo (JP)

(72) Inventors: Atsutoshi Ando, Yokohama (JP); Tohru Saito, Mishima (JP); Eiji Uekawa, Susono (JP); Masashi Tanaka, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/652,785

(22) Filed: Oct. 16, 2012

(65) Prior Publication Data

US 2013/0121736 A1 May 16, 2013

(30) Foreign Application Priority Data

Nov. 10, 2011 (JP) ..... 2011-246933

(51) Int. Cl.
*G03G 15/20* (2006.01)

(52) U.S. Cl.
CPC .... *G03G 15/2057* (2013.01); *G03G 2215/2035* (2013.01)
USPC ..... 399/329; 399/330; 399/331; 399/395

(58) Field of Classification Search
USPC ..... 399/67, 329, 330–331, 395
See application file for complete search history.

(56) References Cited

U.S. PATENT DOCUMENTS 4,419,003 A * 12/1983 Fujie et al. ..... 399/322
5,404,214 A * 4/1995 Yoshimoto et al. ..... 399/329
6,014,539 A * 1/2000 Sano et al. ..... 399/329
6,496,661 B2 * 12/2002 Ando et al. ..... 399/22
6,944,420 B2 * 9/2005 Kanamori et al. ..... 399/329
6,952,538 B2 * 10/2005 Hashiguchi et al. ..... 399/45
7,190,917 B2 * 3/2007 Suzumi et al. ..... 399/88

FOREIGN PATENT DOCUMENTS

JP 02131273 A * 5/1990
JP 3-266870 A 11/1991
JP 10-228192 A 8/1998
JP 4054488 B2 2/2008
JP 2008-209459 A 9/2008
JP 4474478 B2 6/2010

OTHER PUBLICATIONS

Nakamura, Kazuto. "Fixation Device". Nov. 11, 1988. Patent Abstracts of Japan, English Translation of the Abstract.*
English Translation of Nakamura, Kazuto. Fixation Device, May 21, 1990. Japanese Patent Office.*

* cited by examiner

*Primary Examiner* — Clayton E LaBalle
*Assistant Examiner* — Trevor J Bervik
(74) *Attorney, Agent, or Firm* — Canon USA Inc IP Division

(57) ABSTRACT

An image heating device includes an endless belt including a base layer and an elastic layer formed around the base layer, a contact member contacting an inner surface of the endless belt, a pressure rotating member forming a nip portion configured to convey a recording material while nipping the recording material along with the contact member via the endless belt, wherein an image formed on the recording material is heated at the nip portion using heat from the endless belt, and wherein one end of the endless belt is coated with the elastic layer and the other end of the endless belt is not coated with the elastic layer, and a belt lateral shifting direction regulating mechanism configured to regulate a direction in which the endless belt shifts when the endless belt is rotated, toward the end coated with the elastic layer.

6 Claims, 8 Drawing Sheets

IMAGE HEATING DEVICE WITH A BELT LATERAL SHIFTING DIRECTION REGULATING MECHANISM

BACKGROUND OF THE INVENTION

1. Field of the Invention

The present disclosure relates to an image heating device for heating an image formed on a recording medium and, in particular, to an image heating device usable as a fixing device or a gloss providing device mounted on an image forming apparatus, such as a copying machine or a printer, which uses an electrophotographic system.

2. Description of the Related Art

In recent years, a color image forming apparatus has appeared. Japanese Patent No. 4474478 discusses a system which provides a heating belt with an elastic layer as a fixing device used in an electrophotographic color image forming apparatus. The reason the heating belt provided with the elastic layer is used is that the surface of the heating belt is caused to follow the unevenness of a toner layer to uniformly melt the toner layer. A resin or metal is used as a base layer of the belt according to applications.

Some image heating devices using a heating belt can control the electric potential of the surface of the heating belt to prevent electrostatic offset or an image defect (hereinafter referred to as tailing) caused by toner on the surface of a recording material blown away by water vapor generated by the recording material. For example, there is sometimes a case where a contact is provided on the end of the heating belt to perform ground (GND) connection or bias application. The surface of the heating belt is controlled to have an electric potential with the same polarity as that of the toner to generate electrostatic force pressing the toner on the surface of the recording material against the recording material, thus preventing the toner from being moved and an image from being deteriorated thereby.

There may be two methods for providing the heating belt with a contact: one for causing a conducting member to contact the inner surface of the heating belt; and the other for applying a conductive brush to an exposed portion of the elastic layer, which is partly peeled away and exposed, of the heating belt. However, if the conducting member is provided on the inner surface of the heating belt, a space inside the cylinder of the belt is decreased along with the decrease of the diameter of the heating belt, thus making it difficult to arrange components and to ensure a distance for insulation between the belt and internal components. If apart of the brush falls out, or the conductive component is worn out, it may remain as a foreign matter in the heating belt to increase drive torque. For that reason, it is desirable to ensure conduction such that the elastic layer of the heating belt is partly peeled away and the conductive brush is applied to the exposed portion from the outside of the belt (refer to Japanese Patent No. 4054488). However, the heating belt may deviate to the left or the right along with the rotation thereof. In this case, the end of the heating belt contacts an edge regulation portion such as a side plate or a flange of the image heating device and the heating belt is rotated while sliding on the edge regulation portion. If the heating belt shifts to the side where the end of the heating belt has the elastic layer, the elastic layer in addition to the base layer contributes to the strength of the heating belt, so that breakdown hardly occurs from the end. On the other hand, if the heating belt shifts to the side where the base layer is exposed, since nothing protects the base layer and the base layer is very thin metallic layer, fatigue breaking is liable to occur. The breakdown of the end of the heating belt may terminate the lifetime of the image heating device before the lifetime of the image forming apparatus is reached, so that inefficiency occurs that requires repair or replacement of the image heating device.

SUMMARY OF THE INVENTION

The present disclosure is directed to an image heating device capable of preventing or reducing fatigue fracture at the end of a belt.

According to an aspect of the present disclosure, an image heating device includes an endless belt including a base layer and an elastic layer formed around the base layer, a contact member contacting an inner surface of the endless belt, a pressure rotating member forming a nip portion configured to convey a recording material while nipping the recording material along with the contact member via the endless belt, in which an image formed on the recording material is heated at the nip portion using heat from the endless belt, and in which one end of the endless belt is coated with the elastic layer and the other end of the endless belt is not coated with the elastic layer, and a belt lateral shifting direction regulating mechanism configured to regulate a direction in which the endless belt shifts when the endless belt is rotated, toward the end coated with the elastic layer.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles as disclosed herein.

DESCRIPTION OF THE EMBODIMENTS

Various exemplary embodiments, features, and aspects of the invention will be described in detail below with reference to the drawings.

Figure 1:
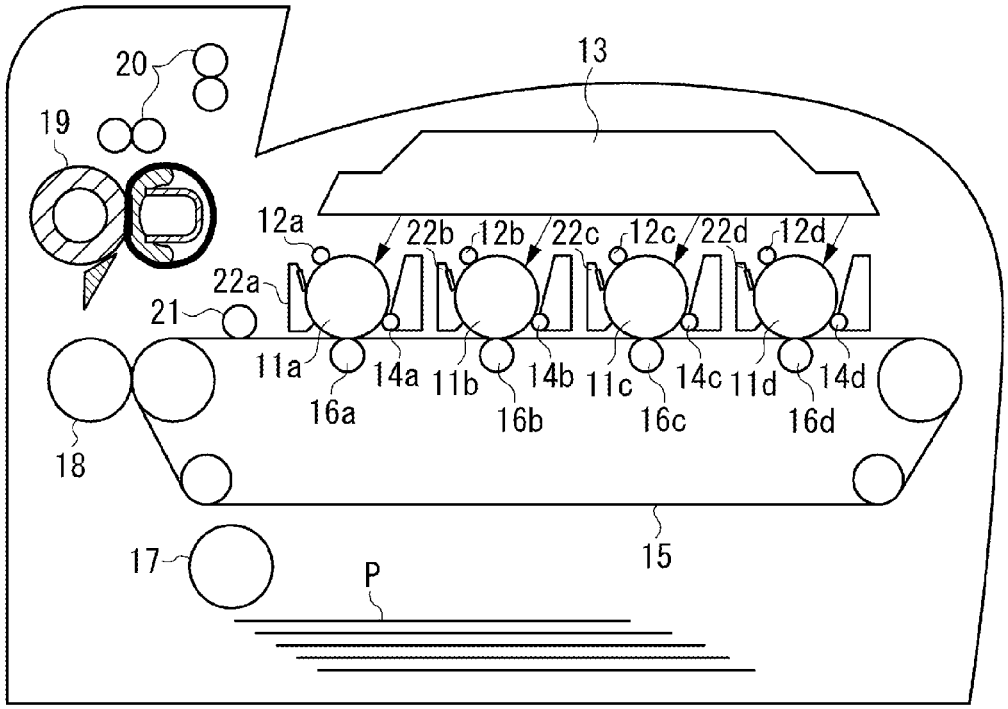
FIG. 1 is a cross section of an image forming apparatus including an image heating device according to a first exemplary embodiment.

A first exemplary embodiment of the present disclosure is described below. FIG. 1 illustrates a general configuration of an example of an image forming apparatus including a heating device according to the first exemplary embodiment of the present disclosure. The image forming apparatus is a color laser beam printer using a electrophotographic system and has separate image forming units corresponding to cyan, magenta, yellow, and black. An image is primary-transferred to an intermediate transfer member and then a full color image on the intermediate transfer member is collectively secondary-transferred to a recording material to acquire the full color image.

A printer described in the present exemplary embodiment receives image information from an image information providing apparatus (not illustrated) such as a host computer provided outside the printer body. When the printer receives a print signal, photosensitive drums 11*a* to 11*d* acting as image bearing members are being driven and rotated. The photosensitive drums 11*a* to 11*d* are driven and rotated counterclockwise at a predetermined peripheral speed. With this, charging rollers 12*a* to 12*d*, acting as a primary charging device, to which a predetermined bias is applied, charge the surface of the photosensitive drums 11*a* to 11*d* to a predetermined electric potential. In the present exemplary embodiment, a laser exposure unit uses a reversal developing system and a charging potential is of a negative polarity.

A laser scanner 13 scans and exposes the charged portion on the surface of the photosensitive drums 11*a* to 11*d* according to the image information from the image information providing apparatus. The laser scanner 13 includes an optical system corresponding to the photosensitive drums 11*a* to 11*d* and separately exposes images corresponding to the photosensitive drums 11*a* to 11*d*. In the exposed area, the electric potential of the surface of the photosensitive drums 11*a* to 11*d* is cancelled and becomes relatively more positive in polarity than the circumference. An electrostatic latent image is formed on the surface of the photosensitive drums 11*a* to 11*d* according to the image information. A developer (toner) charged in negative polarity is supplied to the exposed area, which is relatively more positive in polarity than the unexposed surface is, by developing devices 14*a* to 14*d*. The electrostatic latent image is visualized as a toner image on the surface of the photosensitive drums 11*a* to 11*d*.

The toner image formed on the photosensitive drums 11*a* to 11*d* is primary-transferred to the intermediate transfer belt 15 driven in the same timing as the photosensitive drums 11*a* to 11*d* by primary transfer rollers 16*a* to 16*d*. A recording material P is separately fed one by one by a feeding roller 17 in synchronization with the leading edge of a full-color image on the intermediate transfer belt 15. The recording material P is fed to a secondary transfer nip portion formed between a secondary transfer roller pair 18 and the intermediate transfer belt 15. The toner image on the intermediate transfer belt 15 is transferred to the recording material Pin the process where the recording material P is conveyed while being nipped in the secondary transfer nip portion. The toner image is heated and fixed on the recording material P subjected to the transferring process by a fixing device 19, and the recording material P passes through a discharge roller pair 20 to be discharged outside the printer body. The toner remaining on the intermediate transfer belt 15 is subjected to a charge process by a toner charging roller 21, collected by the photosensitive drums 11*a* to 11*d*, and cleaned by cleaning units 22*a* to 22*d* as is the case with a primary transfer residue toner on the photosensitive drums 11*a* to 11*d*. Thereby, a series of image forming processes is completed.

Figure 2:
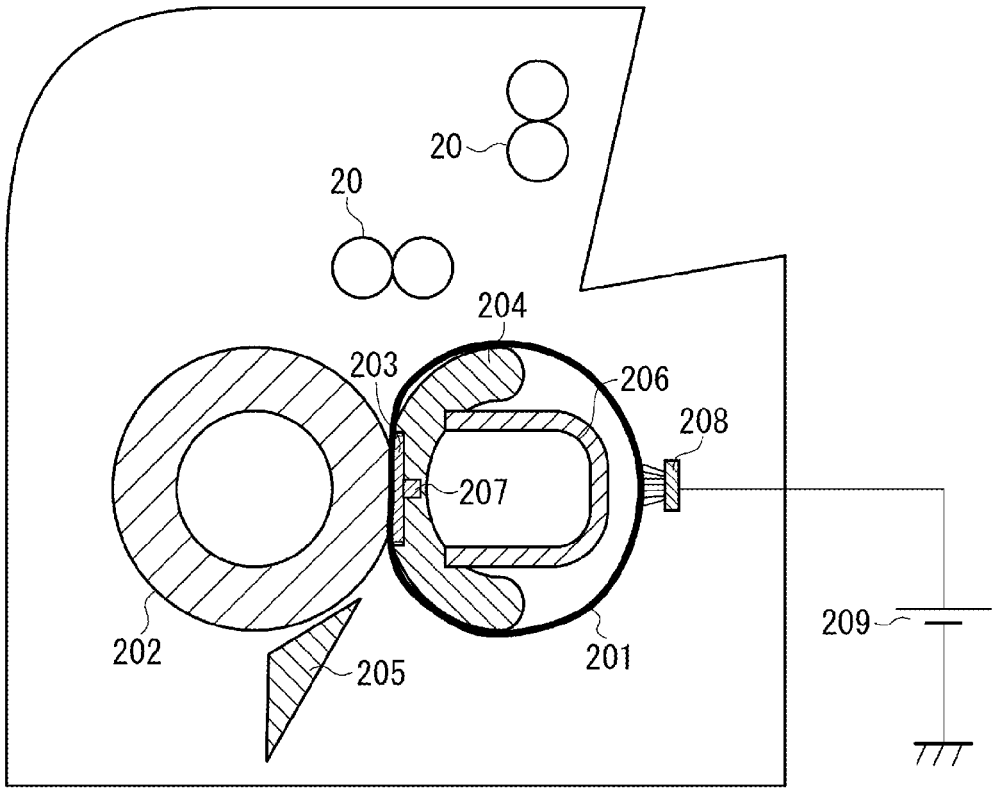
FIG. 2 is across section illustrating a configuration of the image heating device according to the first exemplary embodiment.

An image heating device according to the first exemplary embodiment of the present invention is described in detail below with reference to FIG. 2. As illustrated in FIG. 2, the image heating device includes a heating belt (an endless belt) 201 and a pressure roller (a pressure rotating member) 202. A ceramic heater (a contact member) 203 heats the endless belt. The ceramic heater 203 is held by a heater holder 204 and pressed against the pressure roller 202 by a spring 220 (refer to FIG. 7C) via a metal stay 206 for providing stiffness.

The temperature of the ceramic heater 203 is detected by a thermister 207 being a temperature detecting member. The power supplied to the ceramic heater 203 is controlled according to the detected temperature by a control unit (not illustrated) to adjust the heater to a desired temperature.

A predetermined bias is applied to the heating belt 201 by a power supply 209 being a bias application unit at the longitudinal end thereof. At this point, a contact between a bias application path from the power supply 209 and the heating belt 201 is ensured by causing a conductive brush 208 to contact the surface of the heating belt 201.

An elastic layer is provided on the core of the pressure roller 202 and a release layer is formed thereon. The pressure roller 202 is 18 mm in outer diameter. The ceramic heater 203 is produced such that a resistance heating element such as Ag/Pd is formed on a ceramic substrate by screen printing, and a glass layer is coated and baked thereon. The metal stay 206 is pressed against the pressure roller 202 with a force of 196 N.

Figure 3A:
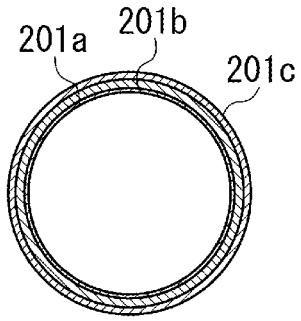
FIGS. 3A and 3B illustrate a configuration of a heating belt.
Figure 3B:
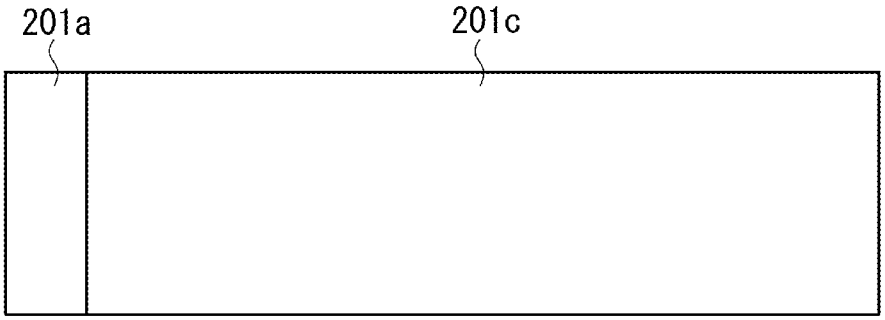

A configuration of the heating belt 201 is described below with reference to FIGS. 3A and 3B. In FIG. 3A, a base layer 201*a* using stainless steel for ensuring a required thermal conductivity in the present exemplary embodiment is a cylindrical belt which is 30 μm in thickness, 18 mm in inner diameter, and 230 mm in overall length. An elastic layer 201*b* is made of silicone rubber in which filler such as alumina is dispersed to increase thermal conductivity in the present exemplary embodiment. In the present exemplary embodiment, the elastic layer is 1.0 W/mK in thermal conductivity and 200 μm in thickness. A release layer 201*c* is a tube layer made of fluororesin. In the present exemplary embodiment, the release layer 201*c* is 30 μm in thickness. As illustrated in FIG. 3B, the elastic layer 201*b* and the release layer 201*c* are peeled at the longitudinal end thereof and the conductive brush 208 is configured to contact the peeled portion (the portion where the base layer 201*a* is exposed). In the present exemplary embodiment, the peeled portion is 8 mm in length.

Figure 7A:
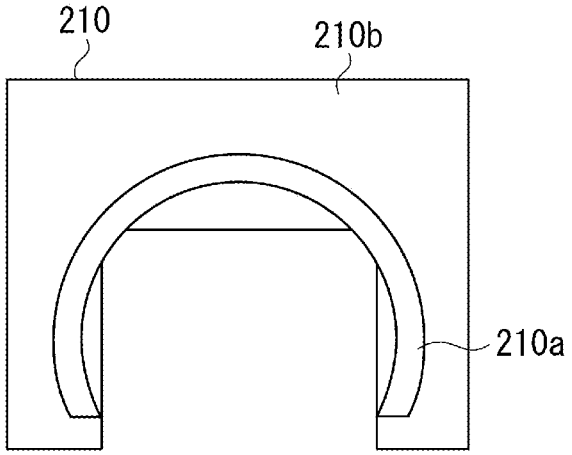
FIG. 7A is a schematic diagram of a flange viewed from the cross section direction.
Figure 7B:
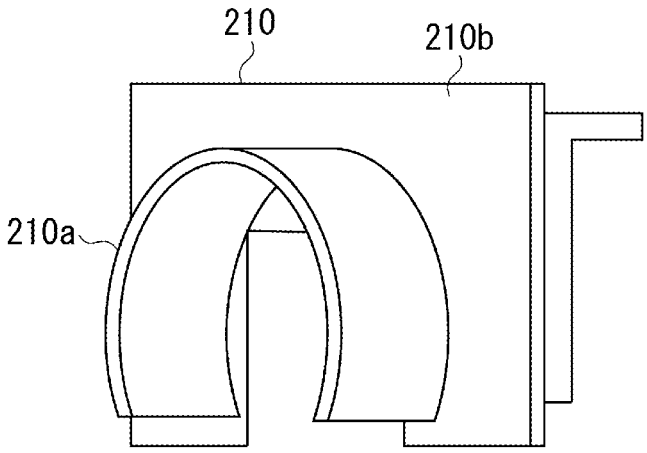
FIG. 7B is a perspective view of the flange.
Figure 7C:
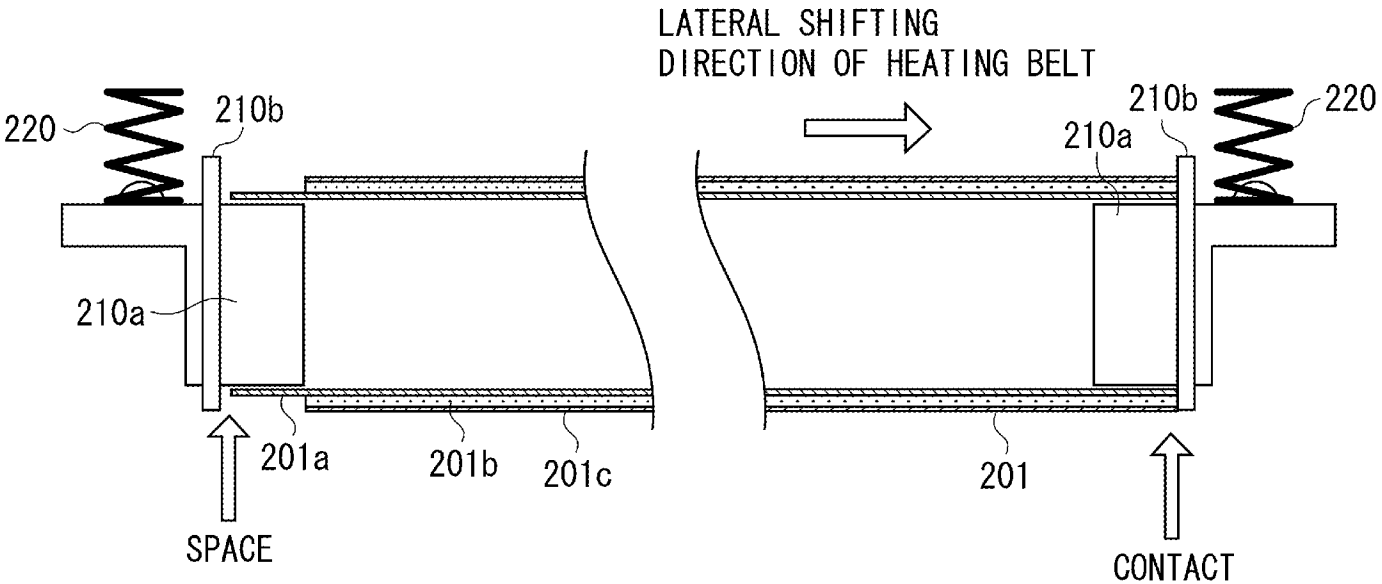
FIG. 7C is schematic diagrams illustrating that the heating belt is attached to the flange.

A flange 210 (a lateral shifting regulating member) for regulating the lateral shifting of the heating belt 201 is described below with reference to FIGS. 7A to 7C. FIG. 7A is a cross-sectional diagram of the flange 210. FIG. 7B is a perspective view of the flange 210. FIG. 7C illustrates a state in which the heating belt 201 is attached to the flange 210. In FIGS. 7A to 7C, the flange 210 includes a regulation portion 210*a* for regulating the inner surface of the heating belt 201 at each end thereof and a contact surface 210*b*, which each end of the heating belt 201 contacts. A heat resistant resin such as a liquid crystal polymer (LCP) or a polyphenylene sulfide (PPS), in particular, is used as a material for the flange 210.

As illustrated in FIG. 7C, a pair of the flanges 210 is provided at both ends of the heating belt 201 in opposition to each other. However, the end of the heating belt 201 contacts only one of the flanges 210 (only the right-side flange 210 in FIG. 7C). The elastic layer 201*b* on the end of the heating belt 201 contacting the flange 210 is not peeled. The contact surface 210*b* for regulating the lateral shifting of the heating belt 201 may be provided only at the right flange 210 in FIG. 7C.

As described above, the image heating device includes an endless belt including a base layer and an elastic layer formed around the base layer, a contact member contacting the inner surface of the endless belt, and a pressure rotating member forming the nip portion configured to convey the recording material while nipping the recording material along with the contact member via the endless belt. The image heating device uses heat from the endless belt to heat an image formed on the recording material at the nip portion. One end of the endless belt is coated with the elastic layer and the other end of the endless belt is not coated with the elastic layer. The area where the elastic layer does not exist on the other end of the endless belt is contacted by a contact for controlling the electric potential of the endless belt.

Figure 4:
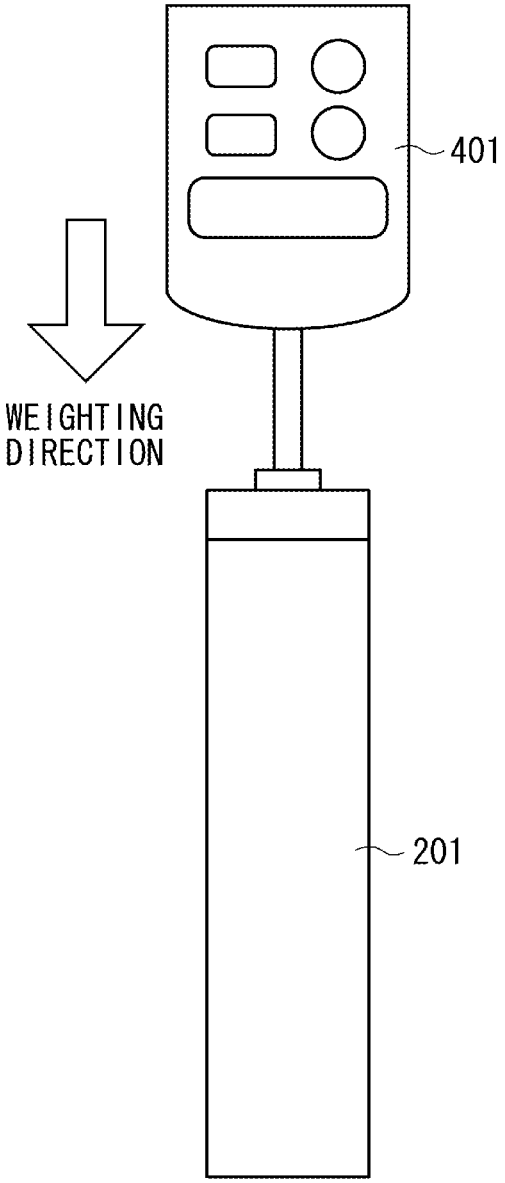
FIG. 4 illustrates a method for acquiring the buckling strength of end of the heating belt.

A method for acquiring buckling strength at the end of the heating belt 201 in the present exemplary embodiment is described in detail below with reference to FIG. 4. As illustrated in FIG. 4, the buckling strength is acquired by reading the indication of a force gauge 401 obtained when force is vertically applied to the end of the heating belt 201 by the tip of the force gauge 401, to the end of which a 7-mm wide flat attachment is fixed, to bend the heating belt 201.

In this case, the buckling strength of the heating belt 201 on the side of the elastic layer 201*b* and the release layer 201*c*, which are coated, was measured five times and was 8.8 N to 19.6 N (12.7 N on average). On the other hand, the buckling strength of the heating belt 201 on the side of the exposed base layer 201*a* was measured five times and was 5.7 N to 12.8 N (7.7 N on average).

In the image heating device, the pressure roller 202 starts rotating before the recording material P, to which a toner image is transferred, enters the pressure roller 202 and the heating belt 201 is also driven to be rotated. The recording material P is guided to a heating nip portion formed between the pressure roller 202 and the heating belt 201 along an inlet guide 205 and heated and pressed therein.

As illustrated in FIG. 7C, along with the drive of the image heating device, the heating belt 201 is rotated while the right end thereof is sliding on the flange contact surface 210*b*.

Figure 5:
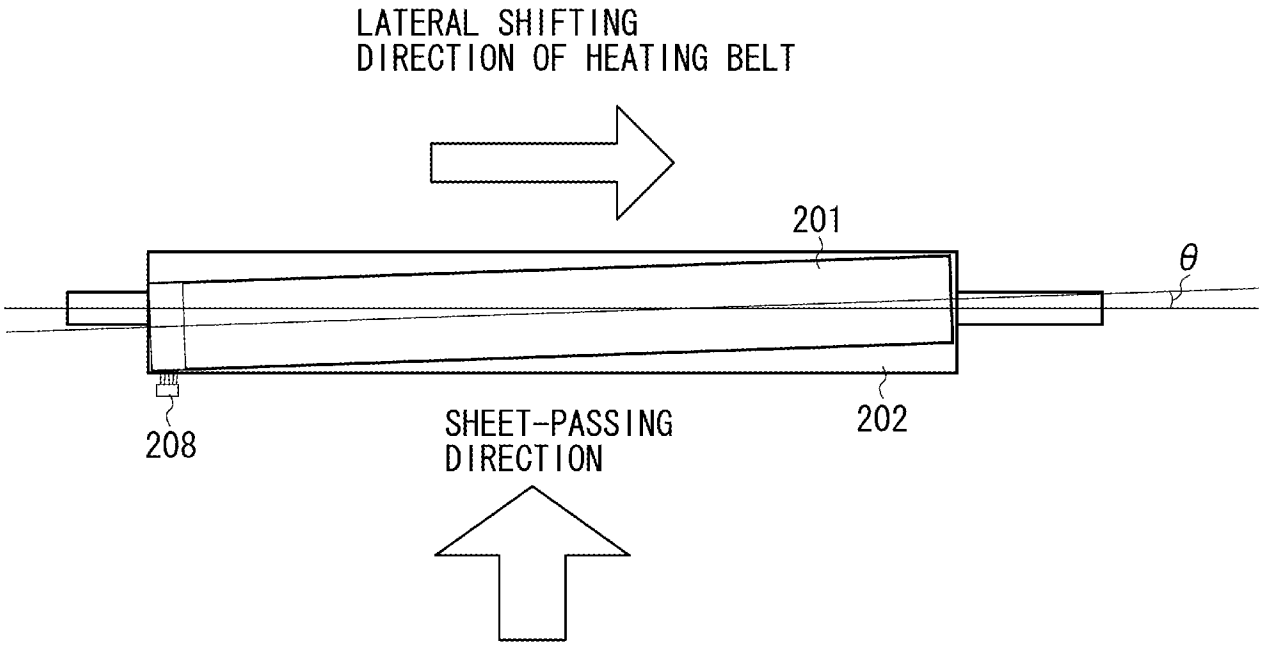
FIG. 5 is schematic diagram for illustrating a method for controlling the direction in which the heating belt shifts according to the first exemplary embodiment.

A method for controlling the direction in which the heating belt 201 shifts (a belt lateral shifting direction regulating mechanism) is described below with reference to FIG. 5. The heating belt 201 is externally fit to the heater holder 204, and is driven and rotated according to the rotation of the pressure roller 202. The heater holder 204 is arranged at an intersection angle of θ with respect to the pressure roller 202. Thereby, the heating belt 201 receives force moving in the direction of an arrow indicating "lateral shifting direction of heating belt" in FIGS. 5 and 7C. In other words, the intersection angle θ is provided between the endless belt 201 and the pressure rotating member 202 as the belt lateral shifting direction regulating mechanism.

Force shifting the heating belt 201 can be acquired by measuring force received by the pressure roller 202 such that the force gauge is applied to the end of the core of the pressure roller 202 receiving reaction force caused by the movement of the heating belt 201. According to the above measurement method, the force shifting the heating belt 201 at the intersection angle θ of about one degree was 5.9 N. In the present exemplary embodiment, the intersection angle is set to one degree.

In the present exemplary embodiment, the end of the heating belt 201, which is coated with the elastic layer 201*b* and the release layer 201*c*, is strong enough for force pressed by the drive of the image heating device, even if the variation of the buckling strength measurement value is a minimum value. For this reason, the end of the heating belt 201 is neither buckled nor broken even in an endurance test, so that the performance of the heating belt 201 can be utilized until its lifetime runs out.

The minimum value of the buckling strength at the side where the base layer 201*a* of the heating belt 201 is exposed is smaller than shifting force of the heating belt 201. If a portion which is small in buckling strength touches the side surface of the image heating device, the heating belt 201 is buckled and bent. The heating belt 201 is subjected to repetitive stress by buckling and bending to cause metal fatigue in the base layer 201*a* of the heating belt 201, thus resulting in cracking or breaking of the heating belt 201.

An endurance test was conducted to examine the effect of the image heating device according to the present exemplary embodiment. The image heating device according to the present exemplary embodiment was actually incorporated into an image forming apparatus (product name: Laser Jet Pro CP1525, produced by Hewlett Packard, and process speed 48 mm/sec). Fifty thousand sheets of letter-size plain paper (product name: Xerox Business 4200) with a grammage of 75 g/m$^2$ were continuously passed. As a result, no abnormality to be mentioned was found in the image heating device.

A comparative example is described below. The comparative example uses the image forming apparatus and the image heating device similar to those used in the first exemplary embodiment. However, the comparative example is different from the first exemplary embodiment in that the intersection angle is reversely provided. The intersection angle is reversely provided to cause the heating belt 201 to deviate in the direction opposite to that in the first exemplary embodiment, that is, the exposed side of the base layer 201*a* is pressed against the flange contact surface 210*b* with a force of 5.9 N.

An endurance test similar to that in the first exemplary embodiment was conducted using the image heating device according to the comparative example. As a result, the end of the base layer 201*a* on the exposed side thereof was cracked when about ten thousand sheets of paper passed. Before twenty thousand sheets of paper passed, the heating belt 201 broken down in a funnel shape. Traces of broken portions were observed on a displayed image.

In the comparative example, the buckling strength on the side where the base layer 201*a* of the heating belt 201 is exposed is approximately 5.7 N, so that, when the exposed base layer 201*a* is pressed against the flange contact surface 210*b* with a force of 5.9 N, weak portions in the base layer 201*a* of the heating belt 201 is buckled and bent. The heating belt 201 was repetitively buckled to cause metal fatigue, which finally cracks and breaks down the heating belt 201.

As described above, a force is generated for causing the heating belt 201 to deviate in the direction, which is opposite to the exposure side of the base layer 201*a* at the end of the heating belt 201, not to press the exposure side of the base layer 201*a* against the side surface of the image heating device. That configuration can prevent the heating belt 201 from being buckled and broken, and can improve reliability of the image heating device.

A second exemplary embodiment of the present invention is described below. In the present exemplary embodiment, the pressure roller 202 is configured to be tapered to control a direction in which the heating belt 201 shifts. In other words, the pressure rotating member is tapered to serve as the belt lateral shifting direction regulating mechanism.

Figure 6:
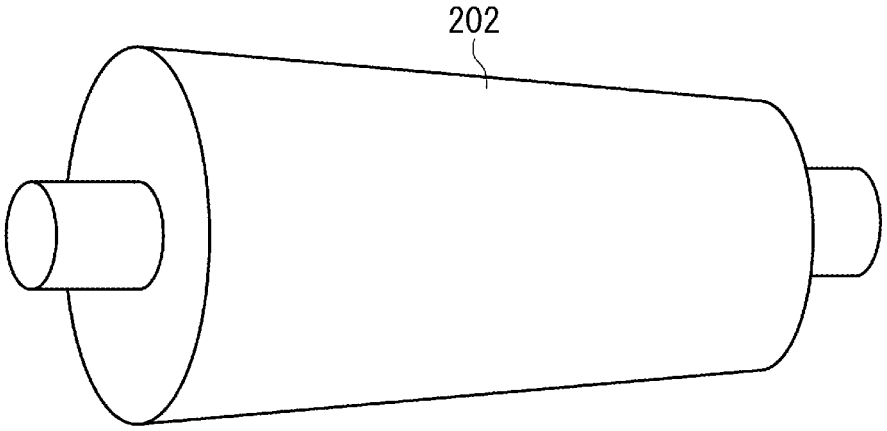
FIG. 6 is a schematic diagram for illustrating a method for controlling the direction in which the heating belt shifts according to the second exemplary embodiment.

FIG. 6 illustrates a shape of the pressure roller 202 according to the present exemplary embodiment. As illustrated in FIG. 6, an external form on the left of the pressure roller 202 (the exposure side of the base layer 201*a* of the heating belt 201) is made greater than that on the right, and the pressure roller 202 is incorporated into the image heating device similar to that in the first exemplary embodiment. However, the intersection angle θ is not provided between the heating belt 201 and the pressure roller 202.

In this case, since the surface speed of the pressure roller 202 on the left, which is greater in an outer diameter, becomes higher, the heating belt 201 receives the similar deviating force as that in the first exemplary embodiment to move in the same direction as that in the first exemplary embodiment.

In the present exemplary embodiment, the outer diameter of the pressure roller 202 on the left side of the heating belt 201 was made greater by about 1 mm than that on the right side of the heating belt 201. As a result, it was observed that the heating belt 201 deviated with a force of about 5.9 N toward the side where the base layer 201*a* of the heating belt 201 is not exposed.

As is the case with the first exemplary embodiment, in the present exemplary embodiment, the exposure side of the base layer 201*a* of the heating belt 201 is not pressed against the flange contact surface 210*b*, which is capable of an improvement in reliability of the image heating device.

An endurance test similar to that in the first exemplary embodiment was conducted using the image heating device according to the present exemplary embodiment. Fifty thousand sheets of paper were continuously passed. As a result, no problem was found in the image heating device.

As described above, a difference in outer diameter is made between the left and right of the pressure roller 202 to generate a force for causing the heating belt 201 to deviate in the direction, which is opposite to the exposure side of the base layer 201*a* at the end of the heating belt 201, not to press the exposure side of the base layer 201*a* against the flange contact surface 210*b*. That configuration can prevent the heating belt 201 from being buckled and broken and can improve reliability of the image heating device.

In addition to the above example, a pressure force applied between the contact member and the pressure rotating member may be different between one end side and the other end side (such that a pressure applied by the left and right springs 220 illustrated in FIG. 7C is different), as the belt lateral shifting direction regulating mechanism.

The image heating device to which the exemplary embodiments of the present invention can be applied may include a halogen heater used as a heat source or an endless belt generating heat by itself.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-246933 filed Nov. 10, 2011, which is hereby incorporated by reference herein in its entirety.

What is claimed is:

1. An image heating device comprising:

an endless belt including a base layer and an elastic layer formed around the base layer;

a contact member contacting an inner surface of the endless belt;

a pressure rotating member forming a nip portion configured to convey a recording material while nipping the recording material, along with the contact member via the endless belt;

wherein an image formed on the recording material is heated at the nip portion using heat from the endless belt;

wherein one end of the endless belt is coated with the elastic layer and the other end of the endless belt is not coated with the elastic layer; and a belt lateral shifting direction regulating mechanism configured to regulate a direction in which the endless belt shifts when the endless belt is rotated, toward the end coated with the elastic layer, wherein a pressure force applied between the contact member and the pressure rotating member is different between one end side and the other end side of the endless belt, and the different pressure force functions as the belt lateral shifting direction regulating mechanism.

2. The image heating device according to claim 1, wherein a contact for controlling an electric potential of the endless belt contacts an area of the other end of the endless belt that is not coated with the elastic layer.

3. The image heating device according to claim 1, wherein a material of the base layer includes a metal.

4. The image heating device according to claim 1, wherein an intersection angle greater than zero degrees is provided between the endless belt and the pressure rotating member, and the intersection angle functions as the belt lateral shifting direction regulating mechanism.

5. The image heating device according to claim 1, wherein the pressure rotating member has a tapered shape in which a diameter of the pressure rotating member is decreased from one end to the other end thereof, and the tapered shape functions as the belt lateral shifting direction regulating mechanism.

6. The image heating device according to claim 1, wherein the contact member includes a heater for heating the endless belt.

* * * * *